United States Patent [19]

Wilde

[11] 4,002,510

[45] Jan. 11, 1977

[54] STAINLESS STEEL IMMUNE TO STRESS-CORROSION CRACKING

[75] Inventor: Bryan E. Wilde, Indiana Township, Allegheny County, Pa.

[73] Assignee: United States Steel Corporation, Pittsburgh, Pa.

[22] Filed: May 1, 1975

[21] Appl. No.: 573,652

[52] U.S. Cl. ..... 148/38; 75/125; 75/128 C; 75/128 N; 148/37

[51] Int. Cl.[2] ..... C22C 38/02; C22C 38/40

[58] Field of Search ..... 75/128 C, 128 N, 125; 148/37, 38

[56] References Cited

UNITED STATES PATENTS

| | | | |
|---|---|---|---|
| 3,523,788 | 8/1970 | Bates | 75/128 N |
| 3,563,728 | 2/1971 | Allio | 75/128 N |
| 3,785,787 | 1/1974 | Yokota et al. | 75/125 X |
| 3,806,337 | 4/1974 | Jones | 75/128 C |

*Primary Examiner*—Arthur J. Steiner
*Attorney, Agent, or Firm*—Forest C. Sexton

[57] ABSTRACT

An austenitic stainless steel immune to stress-corrosion cracking and integranular stress-corrosion cracking in both the annealed and cold worked condition. The steel consists essentially of 0.005 – 0.08% carbon, 0.01 – 0.04% nitrogen, 16.0 – 20.0% chromium, 8.0 – 10.0% nickel, and 3.5 – 5.5% silicon, to form a microstructure consisting of 7 to 45 volume % delta ferrite in an austenitic matrix. The steel is further characterized by exceptional resistance to pitting corrosion and intergranular attack and good weldability and hot and cold workability.

4 Claims, No Drawings

STAINLESS STEEL IMMUNE TO STRESS-CORROSION CRACKING

Because of their exceptional corrosion resistant characteristics, stainless steels have had widespread use as constructional materials in the chemical industry. Despite their many advantages, however, some stainless steels, particularly the austenitic grades, do suffer some rather serious limitations due to their susceptibility to stress-corrosion cracking. In fact, all austenitic stainless steels are susceptible to stress-corrosion cracking in chloride containing environments, particularly at elevated temperatures; and when sensitized by welding or heat treatment, most suffer from intergranular stress-corrosion cracking in many environments at high temperatures. Stress-corrosion cracking is hereby defined as a localized form of corrosive attack caused by the conjoint action of a corrosive environment and stress. Two types of cracking can occur in practice identified by the crystallographic mode of attack; transgranular cracking commonly called stress-corrosion cracking and intergranular cracking commonly referred to as intergranular stress-corrosion cracking.

In the past few years, several new stainless steels have been developed which have improved resistance to stress-corrosion cracking and/or intergranular stress-corrosion cracking. Although these steels do provide considerable improvement, they are rather expensive due to their high alloy content, and they still suffer from intergranular attack in a weld heat affected zone and pitting corrosion in chloride environments. Although it is known that careful control of alloy content may overcome one or more of the above corrosion phenomena, no austenitic stainless steel is known which displays good resistance to all. For example, it is known that molybdenum additions may appreciably improve pitting corrosion in some austenitic stainless steels. However, molybdenum may have a pronounced deleterious affect on stress-corrosion cracking. In spite of the growing use of these newer austenitic stainless steels, stress-corrosion cracking and intergranular stress-corrosion cracking are still problems that must be confronted, since these steels are not immune thereto particularly in a heavily cold-worked condition.

Although it is possible to minimize the problems of stress-corrosion by the application of stress-relieving treatments and careful design of structural members to minimize stresses, such preventive measures are usually expensive and not always reliable or practical. In load-bearing structures, stresses cannot be completely eliminated, and in many applications, intentional cold-working is desired to enhance the strength levels of the steel in service.

This invention is predicated on the development of a new and improved austenitic stainless steel which is virtually immune to stress-corrosion cracking and intergranular stress-corrosion cracking in either the annealed or cold worked condition. The steel is further characterized by good resistance to intergranular attack and pitting corrosion, and displays good hot and cold workability and weldability, and exceptionally good strength characteristics.

It is an object of this invention to provide a new and improved austenitic stainless steel which is virtually immune to stress-corrosion cracking and intergranular stress-corrosion.

It is another object of this invention to provide an austenitic stainless steel virtually immune to stress-corrosion problems and having good resistance to pitting and intergranular attack in a weld heat effected zone, good hot and cold workability, good weldability, and exceptional strength characteristics.

It is still another object of this invention to provide an austenitic stainless steel ideally suited for applications in chloride environments in either the annealed or cold-worked condition.

It has recently been learned that small additions of silicon, i.e. about 2%, to some austenitic stainless steels can significantly improve the steel's resistance to stress corrosion cracking (U.S. Pat. No. 3,523,788, Bates et al.). On the other hand, such use of silicon may not only adversely affect the steel's weldability, but can cause difficulties associated with sensitization, and thus detrimentally affect resistance to intergranular attack. The crux of this invention resides in the discovery that modestly excessive amounts of silicon, i.e. 3.5 to 5.5%, in a conventional 18% chromium, 8% nickel stainless steel will cause the introduction of significant amounts of delta ferrite in the austenitic matrix. Such a duplex microstructure has been found to have exceptional unexpected results, namely, it renders the steel virtually immune to stress-corrosion cracking and intergranular stress corrosion cracking, as well as improving the steel's resistance to pitting corrosion and intergranular attack. In addition, the steel will have an increased yield and tensile strength, good hot and cold working properties and good weldability.

In its broadest aspect, the stainless steel of this invention has an essential composition as follows:

| | |
|---|---|
| carbon | 0.005 to 0.08% |
| nitrogen | 0.01 to 0.04% |
| chromium | 16.0 to 20.0% |
| nickel | 8.0 to 10.0% |
| silicon | 3.5 to 5.5% |
| iron and impurities | balance |

The usual impurities may of course be tolerated within the usual residual levels, e.g. up to 0.02% sulfur, up to 0.03% phosphorus, up to 0.5% molybdenum, up to 1.5% manganese, up to 0.15% copper and up to 0.02% aluminum. It may be recognized that the above steel is basically an AISI Type 304 stainless steel modified to contain a positive and excessive amount of silicon, i.e. sufficient silicon to render an appreciable amount of precipitated delta ferrite in an austenitic matrix. It is essential that the delta ferrite should consist of from 7 to 45 volume % of the steel's microstructure, and preferably from 17 to 45% . Although superior corrosion behaviour can be readily maintained within the above composition range, somewhat closer controls are preferred in order to optimize mechanical properties. For example, to assure good hot workability, it is preferred that the carbon, nitrogen and silicon contents be maintained at less than maximum value. Accordingly, for optimum corrosion resistance, mechanical properties and economic considerations, the above steel is preferably maintained within the following composition range:

| | |
|---|---|
| carbon | 0.005 to 0.03% |
| nitrogen | 0.01 to 0.02% |
| chromium | 17.0 to 19.0% |
| nickel | 8.0 to 9.0% |
| silicon | 4.0 to 5.0% |

-continued

| | |
|---|---|
| iron and impurities | balance |

There are of course a number of ferrite forming elements in addition to silicon, e.g. molybdenum, tungsten, vanadium, etc., which could be utilized to form essentially the same microstructure. For reasons not completely understood, however, identical alloys ferritized with any of the other ferrite forming elements do not display the same remarkable immunity to stress-corrosion problems, as does the above alloy ferritized with silicon. In fact, it is preferred that the amounts of other ferrite forming elements be kept to residual levels, as any apppreciable amount thereof may be detrimental to the stress-corrosion immunity, and will usually sensitize the steel to intergranular attack in a weld heat affected zone.

Although the inventive steel's immunity to stress-corrosion cracking and intergranular stress-corrosion cracking are quite unexpected, it is not surprising that the steel displays somewhat superior strength levels. Obviously, the dispersed ferrite precipitate will have a stiffening effect which will increase strength, both yield and tensile, in either the annealed or cold worked condition.

To graphically illustrate the advantages of this invention, Table I below compares the stress-corrosion properties of eight prior art stainless steels with a stainless steel representative of this invention.

In the above table, the first four AISI stainless steels (A–D) are but four of the more common grades, and are not recognized for being resistant to stress-corrosion problems. On the other hand, Alloys E through H are prior art specialty alloys which are sold because of their exceptional resistance to stress-corrosion problems. In this regard, it can be seen that Alloys E-H are indeed significantly superior to Alloys A–D. It is further apparent however, that Alloy I, which is the alloy of this invention is even superior to the prior art alloys E–H which, heretofore, had been considered to be the best for stress-corrosion resistance characteristics.

To further exemplify the inventive concepts of this invention, Table II below, shows nine experimental steels produced with varying silicon contents, and showing the amount of resulting delta ferrite.

Table II

Chemical Composition of Experimental Alloys Containing Silicon Additions

| Alloy No. | C | Mn | P | S | Si | Cu | Ni | Cr | Mo | N | Al | Delta-Ferrite Content-Percent |
|---|---|---|---|---|---|---|---|---|---|---|---|---|
| | Composition, percent | | | | | | | | | | | |
| 1 | 0.055 | 1.53 | 0.006* | 0.014 | 1.01 | 0.09 | 8.83 | 17.3 | 0.019* | 0.039 | 0.007 | <0.1 |
| 2 | 0.054 | 1.49 | 0.006* | 0.015 | 1.95 | 0.09 | 8.87 | 17.1 | 0.02* | 0.038 | 0.012 | <0.1 |
| 3 | 0.059 | 1.49 | 0.005* | 0.014 | 2.85 | 0.09 | 8.94 | 17.2 | 0.02* | 0.036 | 0.015 | 1.7 |
| 4 | 0.059 | 1.49 | 0.005* | 0.013 | 3.73 | 0.09 | 9.06 | 17.0 | 0.021* | 0.033 | 0.018 | 7.5 |
| 5 | 0.060 | 1.49 | 0.005* | 0.014 | 4.45 | 0.09 | 9.07 | 17.0 | 0.02* | 0.032 | 0.020 | 17 |
| 6 | 0.022* | 1.41 | 0.011* | 0.011 | 4.73 | 0.08 | 8.88 | 17.0 | 0.026* | 0.011* | 0.016 | 28 |
| 7 | 0.024* | 1.39 | 0.025 | 0.010 | 4.79 | 0.08 | 8.86 | 17.0 | 0.19 | 0.012* | 0.01 | 28 |
| 8 | 0.058 | 1.37 | 0.025 | 0.011 | 4.76 | 0.08 | 8.88 | 17.0 | 0.19 | 0.33 | 0.01 | 18 |
| 9 | 0.018* | 1.42 | 0.028 | 0.008 | 4.70 | 0.09 | 8.89 | 17.0 | 0.21 | 0.036 | 0.011 | 22 |

*Low value for residual element.

The above experimental steels were all tested along with reference steels, for a variety of properties as will be discussed below. For the first test, bar specimens having a diameter of 0.250 ± 0.005 inch were tension loaded to 75% of room temperature engineering yield strength and then immersed in boiling 42% $MgCl_2$. Failure was defined as that time where double-ended fracture occured and was recorded electrically by means of a micro-switch. The steels were tested in the following conditions:

1. Annealed (1 hour at 2000° F followed by water quench);
2. Annealed plus sensitized (annealed as in (1). followed by 24 hours at 1150° and air cooled); and
3. Cold worked (annealed as in (1). followed by 30% elongation).

Table III below shows these test results.

Table I

Comparison of Prior Art Alloys With Alloy of this Invention

| | Alloy | C | Mn | P | S | Si | Cu | Ni | Cr | Mo | N | Al | Chloride Stress-Corrosion Cracking Data, $MgCl_2$ Time to Failure, hours: Annealed | Cold Worked |
|---|---|---|---|---|---|---|---|---|---|---|---|---|---|---|
| A. | AISI 304L | 0.029 | 1.28 | 0.019 | 0.015 | 0.35 | ND | 9.52 | 18.6 | 0.19 | 0.040 | 0.02 | 5 | 2 |
| B. | AISI 304 | 0.06 | 1.3 | 0.2 | 0.015 | 0.35 | 0.2 | 9.0 | 19.0 | 0.2 | 0.04 | 0.01 | 5 | 2 |
| C. | AISI 316 | 0.061 | 1.69 | 0.027 | 0.029 | 0.35 | ND | 12.06 | 18.09 | 2.31 | 0.041 | ND | 8 | 4 |
| D. | AISI 310 | 0.063 | 1.15 | 0.024 | 0.013 | 0.32 | ND | 20.0 | 24.5 | 0.15 | 0.038 | 0.01 | 15 | 11 |
| E. | Incoloy 800 | 0.038 | 0.83 | 0.017 | 0.005 | 0.33 | 0.31 | 32.1 | 20.2 | 0.074 | 0.013 | 0.24 | 1189 | 167 |
| F. | U.S. Pat. No. 3,159,479 | 0.082 | 0.50 | 0.014 | 0.013 | 1.28 | < 0.05 | 20.9 | 17.7 | 0.03 | 0.029 | 0.005 | NF2000 | 363 |
| G. | URANUS S | 0.014 | 0.84 | 0.030 | 0.018 | 3.87 | 0.10 | 13.8 | 16.8 | 0.22 | 0.035 | 0.02 | 142 | 114 |
| H. | U.S. Pat. No. 3,523,788 | 0.06 | 1.5 | 0.009 | 0.01 | 2.0 | 0.02 | 18.0 | 18.0 | 0.02 | 0.02 | 0.003 | NF2000 | 300 |
| I | Steel of This Invention | 0.06 | 1.49 | 0.005 | 0.014 | 4.45 | 0.09 | 9.07 | 17.0 | 0.02 | 0.032 | 0.020 | NF2000 | NF2000 |

ND - Not determined
NF - No failure at indicated times.

TABLE III

Summary of the $MgCl_2$ Stress-Corrosion Cracking Data for the Experimental and Selected Reference Steels With Silicon Additions

| Alloy No. | Additive | % Delta-Ferrite | Time to Failure, hours Annealed | Annealed and Sensitized** | Cold-Worked |
|---|---|---|---|---|---|
| AISI Type 304* | — | — | 5 | ND | 2 |
| U.S. Pat. No. 3,523,788 | — | — | NF2000 | NF2000 | 300 |
| 1 | 1.01 Si | <1 | NF2000 | NF3500 | 5 |
| 2 | 1.95 Si | <1 | NF2000 | NF3500 | 64 |
| 3 | 2.85 Si | 1.7 | NF2000 | NF3500 | 822 |
| 4 | 3.73 Si | 7.5 | NF2000 | NF3500 | NF2000 |
| 5 | 4.45 Si | 17 | NF2000 | NF3500 | NF2000 |
| 6 | 4.7 Si | 28 | NF2000 | ND | NF2000 |
| 7 | 4.8 Si | 28 | NF2000 | ND | NF2000 |
| 8 | 4.8 Si | 18 | NF2000 | ND | NF2000 |
| 9 | 4.7 Si | 22 | NF2000 | ND | NF2000 |

*Reference steels.
**24 hours at 1150 F, air cool.
NF - No failure in time indicated.
ND - Not determined.

Intergranular corrosion tests were conducted on coupons 1 inch by 2 inches machined from strip 0.125 inch thick which had been annealed at 1924° F for 0.5 hours followed by a water quench. Half of the test coupons were blanks of the experimental alloys and the reference steels were surface polished to a No. 4 finish and then degreased.

Standard Huey tests were conducted on (1) annealed and (a) annealed and sensitized materials in boiling reagent grade nitric acid diluted to 65 volume % with distilled water (7.6 megohm cm at 75° F). Each steel was tested in duplicate and was removed after each 48-hour boil period, washed with distilled water, hot air dried, weighed and reimmersed for a further test period. Corrosion rates were calculated for each boil period in mils penetration per month (mpm) by using a steel density factor of 7.93 g/cm$^3$.

Intergranular corrosion tests were also conducted in a modified Strauss test as follows. Coupons were degreased in trichloroethylene, passivated in 20 volume percent nitric acid at 140° F (60° C) for 20 minutes, and placed in a copper rack in a reaction kettle. The specimens were covered with copper shot and 200 ml of a test solution consisting of 600 g $CuSO_4 \cdot 5H_2O$ and 600 ml concentrated $H_2SO_4$ diluted to 6 liters with distilled water. Tests were run for 24 hours in a boiling solution, after which specimens were removed, washed with distilled water, dried, and visually inspected for evidence of IGA with a 5X eyepiece. Bend tests were also conducted by bending tested and non-tested coupons 180° around a mandrel with a diameter equal to the specimen thickness. The results of the above Huey corrosion tests are summarized in Table IV.

TABLE IV

Summary of Huey test* Data on Experimental Steels and Reference Alloys

| Alloy No. | Additive | % Delta-Ferrite | Corrosion Rate,** mpm Annealed | Sensitized |
|---|---|---|---|---|
| AISI Type 304L+ | — | <1 | 0.73 | 12.2 |
| AISI Type 304 | — | <1 | 0.66 | >200*** |
| U.S. Pat. No. 3,523,788 | — | <1 | 1.82 | >150*** |
| 1 | 1.01 Si | <1 | 0.79 | 62.3 |
| 2 | 1.95 Si | <1 | 1.73 | 85.93 |
| 3 | 2.85 Si | 1.7 | 2.39 | 91.75 |
| 4 | 3.73 Si | 7.5 | 2.53 | 41.66 |
| 5 | 4.45 Si | 17.0 | 2.37 | 20.39 |
| 6 | 4.7 Si | 28 | ND | 8.0 |
| 7 | 4.8 Si | 28 | ND | 4.15 |
| 8 | 4.8 Si | 18 | ND | 12.3 |
| 9 | 4.7 Si | 22 | ND | ND |

*Conducted for 5 periods of 24 hours in boiling 65% $HNO_3$.
**Averaged from weight corrcs in 5 boils in mils penetration per month.
***After 2 boils the specimens disintegrated.
+Carbon content = 0.029%.

Attention should be focused on the corrosion rate of silicon steels 6, 7 and 8 where penetration rates significantly less than those observed on sensitized AISI Type 304L stainless steel. This latter alloy was specifically designed to have superior resistance to intergranular attack even after sensitization, by maintenance of the carbon level at 0.03% maximum.

Silicon additions from 1 to 5% systematically increase the intergranular corrosion rate from 0.79 mpm to 2.4 mpm. This latter value is approximately four times (X4) that of the commercial austenitic 18Cr-8Ni balance iron alloy (AISI Type 304), but is approximately equal to that of the commercial steels based on U.S. Pat. No. 3,523,788.

Further evidence of the exceptional resistance to intergranular attack of some of the silicon experimental steels could be seen in Strauss test results based on visual inspection. For sensitized specimens, severe intergranular attack was noted on alloys 1, 2 and 3 in addition to the reference stainless steel. At silicon levels above 2.85%, however, a noticeable increase in resistance to intergranular attack was apparent. Alloy 5 (4.45% silicon) evidenced no intergranular attack in agreement with the Huey test results.

Thus, the tests indicate that exceptional resistance to intergranular attack in the annealed and sensitized condition may be achieved by the formation of delta-ferrite in an 18Cr-9Ni balance iron matrix.

For an intergranular stress-corrosion cracking test, tests were conducted on tension specimens having a 0.125 inch diameter. Speciments were loaded to 125% of the engineering yield strength (at 550° F), while immersed in demineralized water containing approximately 100 ppm dissolved oxygen. Failure was identified by double-ended fracture of the specimen and was monitored electrically. Steels were tested in the annealed and sensitized condition (24 hours at 1150° F, air-cool) to simulate a typical pressure vessel stress-relief heat treatment used in the commercial applications. Tests were arbitrarily terminated after 300 hours when no cracking occured, since previous experience has shown that this period corresponds to a very long-term resistance to Intergranular stresscorrosion cracking in service.

The results of the tests are shown in Table V below. The two austenitic control alloys along with experimental alloys 1, 2,3 and 4 all evidenced severe Intergranular stress-corrosion cracking. Alloys 5 through 9 with delta ferrite contents in excess of 17%, all indicated immunity from cracking during the 300-hour test period. Therefore, silicon alloys with approximately 4 to 5% silicon and 0.02 to 0.06% carbon are resistant to Intergranular stress-corrosion cracking in addition to being immune to chloride SCC in boiling $MgCl_2$.

TABLE V

Summary of the Intergranular Stress-Corrosion Cracking Data* for Sensitized Experimental Steels With Silicon Addition

| Alloy No. | Additive | % Delta-Ferrite | Time to Failure,*** hours |
|---|---|---|---|
| AISI Type 304** | — | <1 | 14 |
| U.S. Pat. No. 3,523,788 | — | <1 | 16.2 |
| 1 | 1.01 Si | <1 | 17 |
| 2 | 1.95 Si | <1 | 61 |
| 3 | 2.85 Si | 1.7 | <100 No fracture but fine cracks |
| 4 | 3.73 Si | 7.5 | 92 |
| 5 | 4.45 Si | 17 | NF300 |
| 6 | 4.7 Si | 28 | NF300 |
| 7 | 4.8 Si | 28 | NF300 |
| 8 | 4.8 Si | 18 | NF300 |
| 9 | 4.7 Si | 22 | NF300 |

*Conducted at 289 C in pure water containing 100 ppm dissolved $O_2$. Stressed to 125% of the yield stress at 289 C.
**Reference steels.
***Mean of three test results.
ND - Not determined.

Two types of screening tests were used to evaluate the pitting resistance of the experimental steels: (1) electrochemical determination of the critical breakdown potential and (2) coupon exposure tests in 10% ferric chloride solution with the pH adjusted to 0.9 with concentrated hydrochloric acid.

In the former test, it has been shown that the higher (more positive) the potential at which the passivating film on the steel breaks down under the influence of an externally applied potential, the more resistant to pitting the alloy will be in service.

The ferric-chloride test is one which is commonly used in industry to screen materials for pitting resistance on a very accelerated basis. The combination of low pH and high chloride ion content makes this test one of the most severe pitting environments that can be encountered.

TABLE VI

Summary of Pitting Corrosion Data Obtained on Experimental Silicon and Reference Steels in Acidified $FeCl_3$ and Neutral 3.5 Percent NaCl

| Alloy No. | Silicon Content, % | % Delta-Ferrite | Corrosion Rate In $FeCl_3$, mdd | Critical Breakdown Potential (Volt Versus SCE) |
|---|---|---|---|---|
| 1 | 1.01 | <1 | 1016 | +0.220 |
| 2 | 1.95 | <1 | 634 | +0.275 |
| 3 | 2.85 | 1.7 | 105 | +0.310 |
| 4 | 3.73 | 7.5 | 65 | +0.370 |
| 5 | 4.45 | 17.0 | 50 | +0.990 |
| AISI Type 304 | — | <1 | 2170 | +0.065 |
| U.S. Pat. No. 3,523,788 | — | 0 | 393 | +0.225 |

The performances of the silicon experimental steels and reference steels in these two tests are summarized in Table VI above. A systematic decrease in corrosion rate (expressed as weight loss in milligrams per decimeter per day) was observed with increasing silicon and delta-ferrite content. For the experimental alloy 5, the value of 50 mdd should be compared with the corrosion rates of AISI Type 304 stainless steel and the patented steel, where an improvement of a factor of X40 and X6, respectively, is evident for the silicon duplex alloy.

The corrosion rate trends were completely confirmed by the "critical breakdown potential" $E_c$ measurements. A systematic increase in the value of $E_c$ was observed with increasing silicon/ferrite content, having a maximum for alloy 5.

The resistance to general acid corrosion was determined by weight loss on prepared coupons during exposure to 1 normal sulfuric acid at 75° F for exposure periods extended up to 100 hours after which the coupons were removed, washed, brushed, washed and hot-air-dried.

The results are summarized in Table VII below, where the corrosion rate is expressed in mils penetration per year (mpy). The data show that the resistance to acid corrosion increases with increasing silicon, up to a maximum of 2.85% silicon. Further additions up to 4.5% silicon decreased the corrosion rate down to 4 mpy. This latter value was five times (X5) less than that observed on the AISI Type 304 stainless steel used as reference, and was slightly lower than that observed on the patented stainless steel.

TABLE VII

Summary of Acid Corrosion Data Obtained on Experimental Silicon and Reference Steels in 1N $H_2SO_4$ at 25 C

| Alloy No. | Silicon Context, % | % Delta-Ferrite | Corrosion Rate, mpy Annealed |
|---|---|---|---|
| 1 | 1.01 | <1 | 50 |
| 2 | 1.95 | <1 | 70 |
| 3 | 2.85 | 1.7 | 210 |
| 4 | 3.73 | 7.5 | 30 |
| 5 | 4.45 | 17.0 | 4 |
| AISI Type 304 | — | <1 | 19.3 |
| U.S. Pat. No. 3,523,788 | — | <1 | 5.1 |

The mechanical properties of the experimental steels and commercial reference steels as determined in the annealed condition, are summarized in Table VIII below. Addition of ferritizing elements to produce a duplex structure increased the yield strength of the alloys in the expected manner. In general, the room temperature yield strength of the austenitic base composition (18Cr-9Ni) was approximately doubled with the addition of Si, to form alloys with about 20 to 30% delta-ferrite.

The ductility of the experimental steels varied widely. Elongations between 50 and 65% were observed on the silicon series, with no significant decrease in reduction in area (69 to 78%) as compared to the values found with the commercial reference steels.

The workability of the experimental steels was evaluated using (1) hot-twist tests, (2) hot-rolling procedures, and (3) cold-rolling to sheet product. An attempt was made to produce the work alloys containing 6,7 and 8% silicon in the hope that a further improvement in corrosion properties may result. However, these alloys proved to be so brittle that a 0.05-inch-thick hot-rolled product could not be made. Corrosion tests were therefore not conducted on these alloys and the upper limit of silicon studied was approximately 5%.

The influence of residual elements on the hot-workability of silicon experimental steels is summarized in Table IX. The data show clearly a decrease in workability as the silicon content of the alloy is increased (alloys 1–5) when carbon and nitrogen contents are kept normal and P and Mo contents are maintained low. The data obtained on alloys 6–9 show that maintenance of C and N at low levels while P and Mo are at the normal residual level significantly improved the hot-workability. In the case of alloys 6, 7 and 9, the index of workability is quite close to that observed on the austenitic Type 304 reference steel at 2300° F. Although the hot-twist tests indicate that the alloys 6, 7 and 9 do not have a hot-workability quite as good as the austenitic reference steel, they do suggest that these alloys should be readily hot-rolled in the temperature region of 2300°

TABLE VIII

Mechanical Properties* of Experimental Steels Containing Silicon Additions

| Alloy No. | Silicon Content, % | % Delta-Ferrite | Yield Strength ksi 75 F | Yield Strength ksi 550 F | Tensile Strength, ksi (75 F) | % Elongation in 1 Inch | % Reduction in Area |
|---|---|---|---|---|---|---|---|
| 1 | 1.01 | <1 | 32.8 | 22.8 | 88.4 | 63.0 | 77.9 |
| 2 | 1.95 | <1 | 33.4 | 23.5 | 94.1 | 64.5 | 75.9 |
| 3 | 2.85 | 1.7 | 38.1 | 32.7 | 106.3 | 59.5 | 72.8 |
| 4 | 3.73 | 7.5 | 47.1 | 35.6 | 120.9 | 55.0 | 73.0 |
| 5 | 4.45 | 17 | 55.7 | 39.3 | 131.8 | 53.0 | 73.0 |
| 6 | 4.73 | 28 | 66.4 | 39.4 | 137.5 | 45.7 | 69.0 |
| 7 | 4.79 | 28 | 71.7 | 38.6 | 137.8 | 44.7 | 71.7 |
| 8 | 4.76 | 18 | 63.3 | 37.8 | 139.3 | 50.0 | 71.7 |
| 9 | 4.70 | 22 | 69.1 | 35.9 | 132.0 | 50.0 | 71.9 |
| AISI Type 304** | — | <1 | 35.0 | 17.0 | 85.0 | 70.0 | 70 |
| U.S. Pat. No. 3,523,788 | — | 0 | 35.0 | 21.4 | 77.0 | 63.0 | 75 |

*Determined on solution annealed material.
**Reference steel.
ND - Not determined.

F.

TABLE IX

Hot Workability of Experimental Duplex Stainless Steels

| Alloy No. | Low | Normal | % Si | % Delta-Ferrite | Number of Twists 2000 F | 2100 F | 2200 F | 2300 F | 2400 F |
|---|---|---|---|---|---|---|---|---|---|
| 1 | P, Mo | C, N | 1.0 | <1 | — | — | — | — | — |
| 2 | P, Mo | C, N | 2.0 | <1 | — | — | — | — | — |
| 3 | P, Mo | C, N | 2.9 | 1.7 | 28 | — | 28 | 19 | 5 |
| 4 | P, Mo | C, N | 3.8 | 7.5 | 11 | — | 9 | 6 | 7 |
| 5 | P, Mo | C, N | 4.5 | 17 | 7 | — | 6 | 7 | 3 |

TABLE IX-continued

| Hot Workability of Experimental Duplex Stainless Steels | | | | | | | | | |
|---|---|---|---|---|---|---|---|---|---|
| Alloy No. | Low | Normal | % Si | % Delta-Ferrite | Number of Twists 2000 F | 2100 F | 2200 F | 2300 F | 2400 F |
| 6 | C,P,Mo,N | | 4.7 | 28 | 7 | 8 | 10 | 54 | 19 |
| 7 | C, N | P, Mo | 4.8 | 28 | 7 | 7 | 12 | 50 | 28 |
| 8 | | C,P,Mo,N | 4.8 | 18 | 7 | 7 | 7 | 11 | 1 |
| 9 | C | P,Mo,N | 4.7 | 22 | 7 | 7 | 10 | 43 | 1 |
| Comparison Steels | | | | | | | | | |
| AISI Type 304 | | C,P,Mo,N | | <1 | 30 | 42 | 50 | 52 | — |
| U.S. Pat. No. 3,523,788 | P,Mo,N | C | | 0 | — | 10 | 14 | 26 | 59 |

These latter conclusions were confirmed by hot-rolling experiments conducted on 50-pound laboratory heats of alloy 7. Slab ingots (3 × 5 inch) were hot-charged at 2350° F. Rolling was conducted down to 0.5-inch plate in 10 passes from 2300° F, finishing at about 1800° F. No evidence of edge cracking was observed when the finishing temperature was above 1700° F. At lower temperatures, increasing amounts of edge cracking was observed. Reheating to 2200° F for 30 minutes allowed further hot reduction to 0.125-inch-thick sheet with no edge cracking.

Cold-rolling studies were conducted on the 0.5-inch-thick plates produced by hot-rolling of alloy 7. With no anneal following hot reduction, edge cracking was observed after 30% cold reduction. If the plate was annealed for 1 hour at 1750° F prior to cold reduction, approximately 75% reduction could be achieved with no edge cracking. Metallographic examination of the sheet cross section revealed no internal cracks or damage.

Limited welding tests were conducted on sheet material 0.080 inch thick by running a TIG pass down the center of the sheet at various heat inputs and pass speeds. The results indicate that as expected, the sheet product can be welded easily, with no tendency toward longitudinal or transverse cracking.

The novel feature of the present invention is a stainless steel having a duplex microstructure containing 7 to 45% delta-ferrite in an austenite matrix, and preferably 17 to 40 % with immunity to chloride stress corrosion cracking and Intergranular stress corrosion cracking and superior intergranular, pitting and acid corrosion resistance and acceptable hot-workability. These properties are achieved by control of alloy chemistry, specifically with regard to silicon, carbon and nitrogen contents. A special feature of the invention is the lack of sensitivity to the levels of P and Mo which an be tolerated at normal residual levels.

I claim:

1. An austenitic stainless steel virtually immune to stress-corrosion cracking and intergranular stresscorrosion cracking consisting essentially of 0.005 to 0.08% carbon, 0.01 to 0.04% nitrogen, 16.0 to 20.0% chromium, 8.0 to 10.0% nickel, 3.5 to 5.5% silicon, up to 1.5% manganese, up to 0.15% copper and the balance iron with conventional residual impurities, and having a microstructure consisting of from 7 to 45 volume % delta ferrite in an austenitic matrix.

2. A stainless steel according to claim 1 in which the silicon content is from 4.0 to 5.0% and the microstructure contains from 17 to 45 volume % delta ferrite.

3. A stainless steel according to claim 1 having a carbon content of 0.005 to 0.03%, a nitrogen content of 0.01 to 0.02%, a chromium content of 17.0 to 19.0%, and a nickel content of 8.0 to 9.0%.

4. A stainless steel according to claim 3 having a silicon content of 4.0 to 5.0% and the microstructure contains from 17 to 45 volume % delta ferrite.

* * * * *